US006655544B1

(12) United States Patent
Tanaka et al.

(10) Patent No.: US 6,655,544 B1
(45) Date of Patent: Dec. 2, 2003

(54) CONTAINER WITH A LID

(75) Inventors: Yoshikazu Tanaka, Kagawa-Ken (JP); Takeshi Bando, Kagawa-Ken (JP); Hiroki Ishikawa, Kagawa-Ken (JP); Masaho Hayashi, Tokyo-To (JP); Hiroshi Uematsu, Tokyo-To (JP); Norikazu Shinogi, Tokyo-To (JP); Toshihiko Uenishi, Tokyo-To (JP)

(73) Assignee: Uni-Charm Corporation (JP)

( * ) Notice: Subject to any disclaimer, the term of this patent is extended or adjusted under 35 U.S.C. 154(b) by 0 days.

(21) Appl. No.: 09/831,087

(22) PCT Filed: Sep. 4, 2000

(86) PCT No.: PCT/JP00/05997

§ 371 (c)(1),
(2), (4) Date: May 4, 2001

(87) PCT Pub. No.: WO01/17873

PCT Pub. Date: Mar. 15, 2001

(30) Foreign Application Priority Data

Sep. 6, 1999 (JP) ..... 11-251820
Sep. 6, 1999 (JP) ..... 11-251832
Mar. 10, 2000 (JP) ..... 2000-67046

(51) Int. Cl.[7] ..... B65D 43/14
(52) U.S. Cl. ..... 220/835; 220/254.1
(58) Field of Search ..... 220/259.1, 835, 220/254.1, 827, 833, 836, 831, 838, 326, 829, 254.3, 254.6, 257.7, 254.5

(56) References Cited

U.S. PATENT DOCUMENTS 4,739,900 A * 4/1988 Borst ..... 220/315
5,573,132 A * 11/1996 Kanfer et al. ..... 220/254.3
6,065,626 A * 5/2000 Huang et al. ..... 220/254.5
6,206,221 B1 * 3/2001 Bando et al. ..... 220/254.5

FOREIGN PATENT DOCUMENTS

| | | | |
|---|---|---|---|
| EP | 748748 | * 12/1996 | ..... 220/254.5 |
| JP | 6-32643 | 4/1994 | |
| JP | 10-101106 | 4/1998 | |
| JP | 11-49207 | 2/1999 | |
| JP | WO9919227 | * 4/1999 | ..... 220/254.5 |
| JP | 11-180460 | 7/1999 | |

OTHER PUBLICATIONS

Bando et al. , Freely openable container, Pub. No.: 2002/17522 A1, 2/ 2020.*

* cited by examiner

*Primary Examiner*—Lee Young
*Assistant Examiner*—Lien Ngo
(74) *Attorney, Agent, or Firm*—Parkhurst & Wendel, L.L.P.

(57) ABSTRACT

A container with a lid (10) comprises a container body (11), a lid (23) supported for turning on the container body (11) and a rubber plate (950) provided between the container body (11) and the lid (23). The lid (23) is provided with a stopping projection (32)that engages a catching projection 33 formed in an operating member (55) provided on the container body (11). A slider (60) is supported so as to be slidable on the container body (11). A recess (51) is formed at the lower end of the operating member (55) and a protrusion (61) is formed on the slider (60). In a state where the protrusion (61) of the slider (60) and the recess (51) of the operating member (55) are dislocated from each other, the operating member (55)is restrained from downward movement. Thus the mischievous opening of the lid (23) by children can be prevented.

10 Claims, 9 Drawing Sheets

CONTAINER WITH A LID

TECHNICAL FIELD

The present invention relates to a container with a lid that can be easily opened and closed.

BACKGROUND ART

A container containing things, such as wet tissues, is provided with an opening through which the things are taken out and a lid hermetically closing the opening.

Such a container has a container body containing wet tissues and provided with an opening, and a lid hermetically closing the opening of the container body.

When using the wet tissues contained in the container, the lid is removed from the opening of the container body and the wet tissues are taken out one at a time through the opening.

The conventional container has the container body and the lid supported for turning on the container body. The lid is turned to open to take out the wet tissues from the container body. Sometimes, a child opens the lid and takes a large number of wet tissues only for fun to waste the wet tissues. It is desirable to provide a lid operating part with a function to prevent mischievous opening of the lid.

DISCLOSURE OF THE INVENTION

The present invention has been made in view of such circumstances and it is therefore an object of the present invention to provide a container with a lid provided with a lid that can be surely and easily opened and provided with a function to prevent mischievous opening.

According to one aspect of the present invention, a container with a lid includes: a container body provided with an opening, a lid supported for turning on the container body and capable of hermetically closing the opening; and an elastic biasing member provided between the container body and the lid to bias the lid in an opening direction; wherein the lid is provided at its free end part with a stopping part, the container body is provided with an operating member having a catching part that catches the stopping part of the lid and capable of being bent by an external pressure.

The container with a lid may further include an operating member locking mechanism for locking the operating member.

The container with a lid may further include a lid fastening mechanism for fastening the lid to the container body.

In the container with a lid, the container body may have a top wall provided with the opening, a side wall extending down from the top wall and defining an open lower end, and a bottom wall hermetically closing the open lower end defined by the side wall.

The container with a lid may have a vertical wall holding an operating member locking part, and a cover plate connected to the vertical wall so as to cover the vertical wall and capable of bending the vertical wall when external pressure is applied thereto.

According to the present invention, when the operating member is bent by pressure while the operating member stopping mechanism and the lid fastening mechanism being disengaged, the stopping part of the lid is disengaged from the catching part of the operating member and the lid can be opened by the elastic biasing means.

When the operating member is restrained by the operating member locking mechanism, the operating member does not bend even if the operating member is pressed. The lid is unable to be opened when the same is fastened to the container body by the lid fastening mechanism.

The vertical plate can be bent by applying a pressure to the cover plate from above the cover plate to lower the cover plate. Thus the stopping part of the lid and the catching part of the vertical plate are disengaged and the lid can be opened by the elastic biasing means.

BEST MODE FOR CARRYING OUT THE INVENTION

First Embodiment

Figure 1:
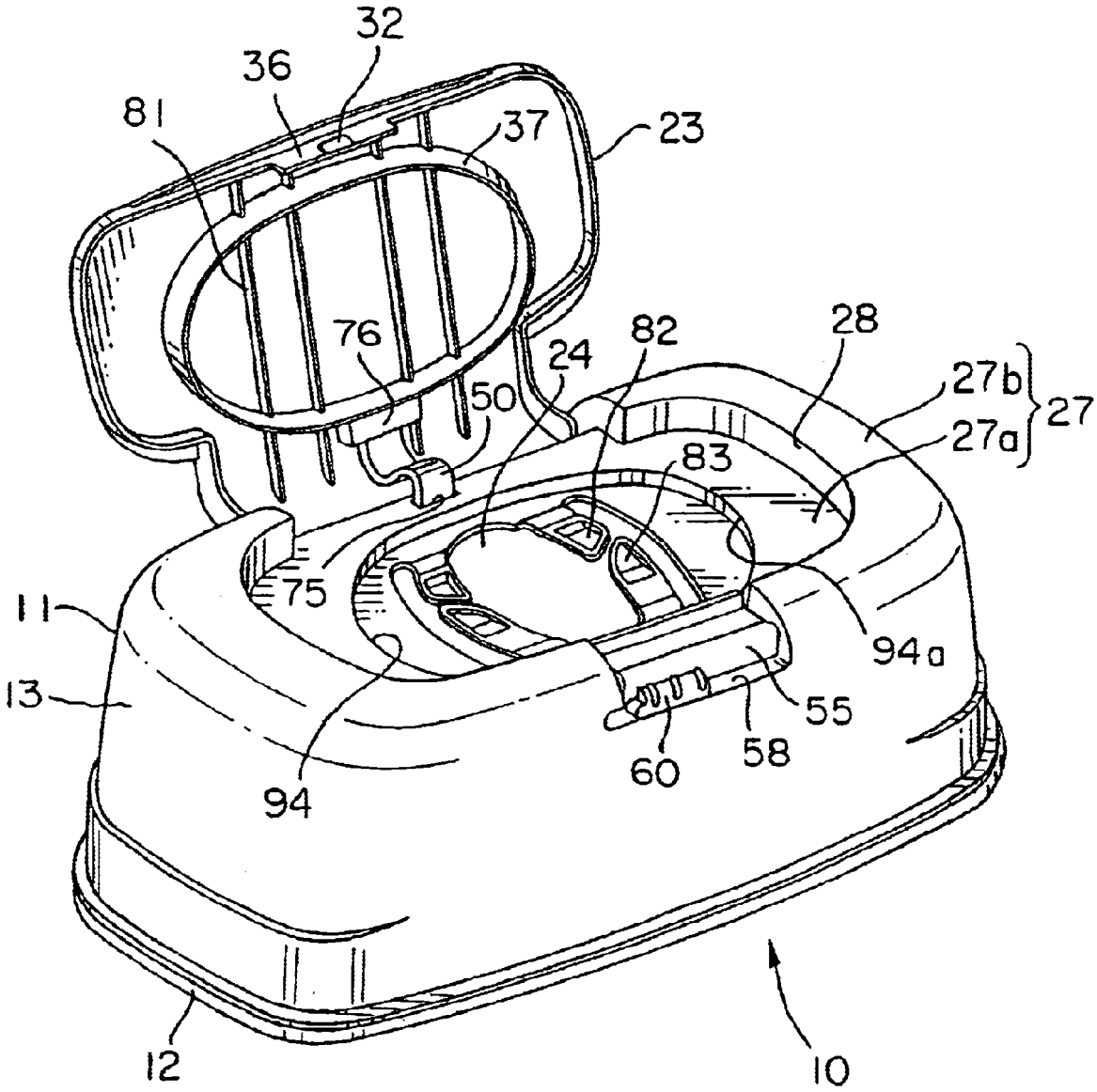
FIG. 1 is a perspective view showing a container with a lid in a first embodiment according to the present invention.
Figure 2:
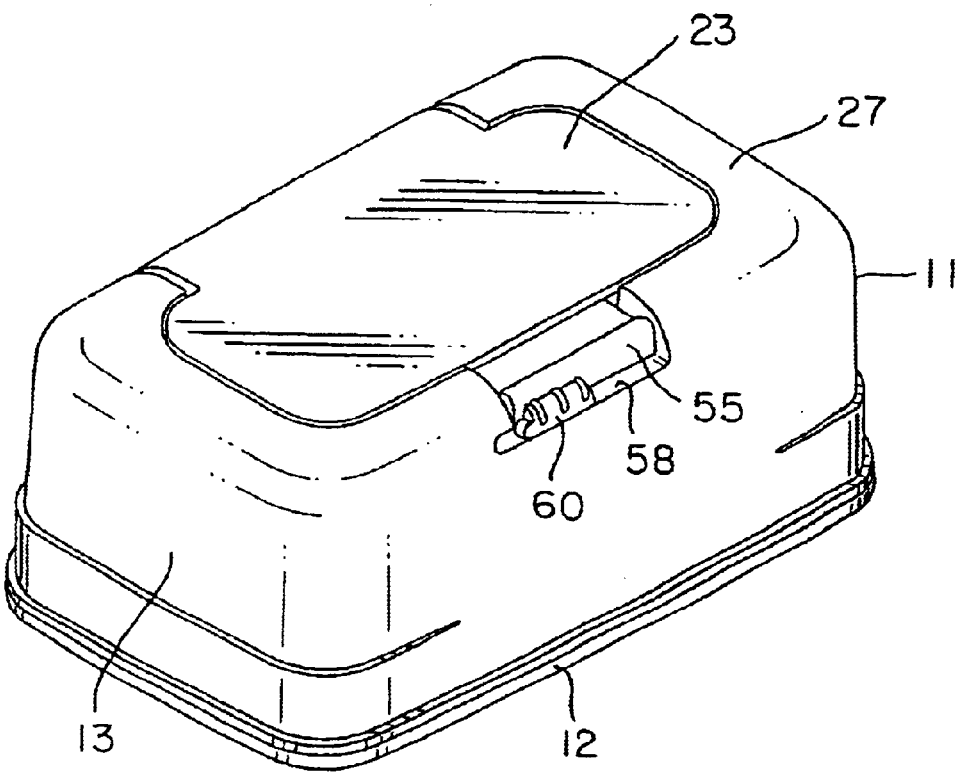
FIG. 2 is a perspective view showing the container with a lid shown in FIG. 1 in a closed state.

Preferred embodiments of the present invention will be described with reference to the accompanying drawings. FIGS. 1 to 6 show a container with a lid in a first embodiment according to the present invention.

Referring to FIGS. 1 to 5, a container with a lid 10 comprises a container body 11 having an open lower end, for containing wet tissues 41 (FIG. 6) and a bottom wall 12 hermetically closing the open lower end of the container body 11. The container body 11 has a top wall 27 provided with an opening 24, and a side wall 13 extending down from the top wall 27. A lid 23 for hermetically closing the opening 24 of the top plate 27 is supported for turning on the side wall 13 of the container body 11.

The top wall 27 of the container body 11 has a first top part (first thin part) 27*a* forming a substantially central part of the top wall 27, an upright part 28 rising from the periphery of the first top part 27*a*, and a second top part (second thin part) 27*b* extending from the upper end of the upright part 28 on a level above that of the first top part 27*a*. The opening 24 through which wet tissues 41 are taken out, is formed in the first top part 27*a*.

The first top part 27*a* is provided with a vertical annular wall 94. The opening 24 is formed in a part of the first top part 27*a* inside the annular wall 94. An annular rib 37 that can be fitted by the annular wall 94 is, formed on the inner surface of the lid 23. The lid 23 is turned so that the annular rib 37 is fitted in the space surrounded by the annular wall 94 to close the opening 24 hermetically. Reinforcing ribs 81 are formed on the inner surface of the lid 23.

As shown in FIG. 1, the lid 23 is provided on its free end part with a side rib 36. A stopping projection 32 is formed integrally with the side rib 36.

An upper end part of the side wall 13 on the side of the free end part of the lid 23 is recessed to form a recessed step 58 recessed from the top wall 27. A vertical wall 55*a* is provided on the recessed step 58. The vertical wall 55*a* has a thin bending part 52. A horizontal wall 55*b* projects forward from a part of the vertical wall 55*a* immediately below the thin bending part 52. A catching projection 33 is formed on the inner surface of the vertical wall 55*a*. The stopping projection 32 of the lid 23 can be engaged with the catching projection 33.

A cover plate 55*c* is joined to the upper end of the vertical plate 55*a* by a hinge 53. The cover plate 55*c* has an L-shaped cross section and is connected by the hinge 53 to the upper end of the vertical wall 55*a* as indicated by two-dot chain lines in FIG. 3. A retaining rib 56 provided with a slot 56*a* is fixed to the inner surface of the cover plate 55*c*. The cover plate 55*c* is turned on the hinge 53 and the horizontal wall 55*b* is received in the slot 56*a*. Thus, the cover plate 55*c* covers the vertical wall 55*a* and the horizontal wall 55*b*, and is connected to the vertical wall 55*a* and the horizontal wall 55*b*. The vertical wall 55*a*, the horizontal wall 55*b* and the cover plate 55*c* constitute an operating member 55 indicated by continuous lines in FIG. 3.

As shown in FIG. 1, an elongate rubber plate 50 is extended between the container body 11 and the lid 23 to bias the lid 23 in an opening direction. The rubber plate 50 has one end inserted in a slot 75 formed in the container body 11, and the other end fastened to a holding part 76 formed on the lid 23 and spaced a predetermined distance apart from the container body 11.

As shown in FIG. 1, the rubber plate 50 is extended between respective middle parts of the container body 11 and the lid 23.

The container body 11 and the lid 23 are formed of a polypropylene resin (PP) by injection molding. The container body 11 and the lid 23 may be formed of any one of PE resins, PS resins, ABS resins, elastomers, PET resins, PVC resins and polycarbonate resins. Preferably, the bottom wall 12 is formed of a linear, low-density polyethylene resin (LLDPE). The rubber plate 50 is formed of silicone rubber. The holding part 76 is formed of a PP resin.

The operating member 55 will be described. As mentioned above, the operating member 55 includes the vertical wall 55*a*, the horizontal wall 55*b* and the cover plate 55*c* covering the vertical wall 55*a* and the horizontal wall 55*c*. Projections 57 project from the outer surface of the vertical wall 55*a*. The projections 57 support the cover plate 55*c* so as to extend perpendicularly to the vertical wall 55*a*.

A pressure exerted on the cover plate 55*c* to depress the cover plate 55*c* is transmitted through the projections 57 and the retaining rib 56 to the vertical wall 55*a* and the horizontal wall 55*b*, respectively. Consequently, the vertical wall 55*a* is bent along the thin bending part 52 in a clockwise direction as viewed in FIG. 3, and the horizontal wall 55*b* is bent in the same direction.

When the vertical wall 55*a* is thus bent in a clockwise direction, the stopping projection 32 of the lid 23 is disengaged from the catching projection 33 of the vertical wall 55*a*.

When the pressure is removed from the cover plate 55*c*, the horizontal wall 55*b* returns to its original horizontal position. Consequently, the cover plate 55*c* retained on the horizontal wall 55*b* by the retaining rib 56, and the vertical wall 55*a* connected to the cover plate 55*c* by the projections 57 return to their original positions, respectively.

Figure 5:
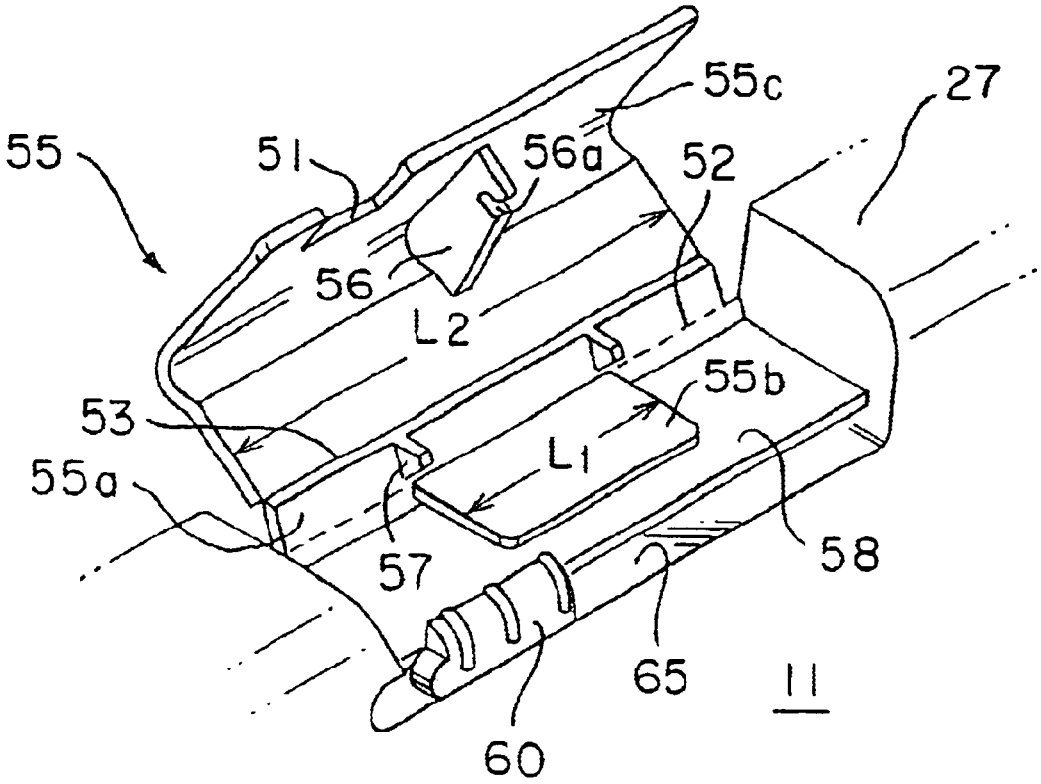
FIG. 5 is a perspective view showing an operating member and a moving member.

As shown in FIG. 5, the width $L_1$ of the horizontal wall 55*b* is smaller than the width $L_2$ of the cover plate 55*c*. The horizontal wall 55*b* does not have any thin part and is comparatively rigid. The comparatively rigid horizontal wall 55*b* can be easily bent because the horizontal wall 55*c* has the comparatively small width $L_1$.

As shown in FIGS. 1 to 5, a slide step 65 is formed on the outer side of the recessed step 58 on a level below that of the recessed step 58. A slider 60 is supported for sliding motion on the slide step 65.

Figure 3:
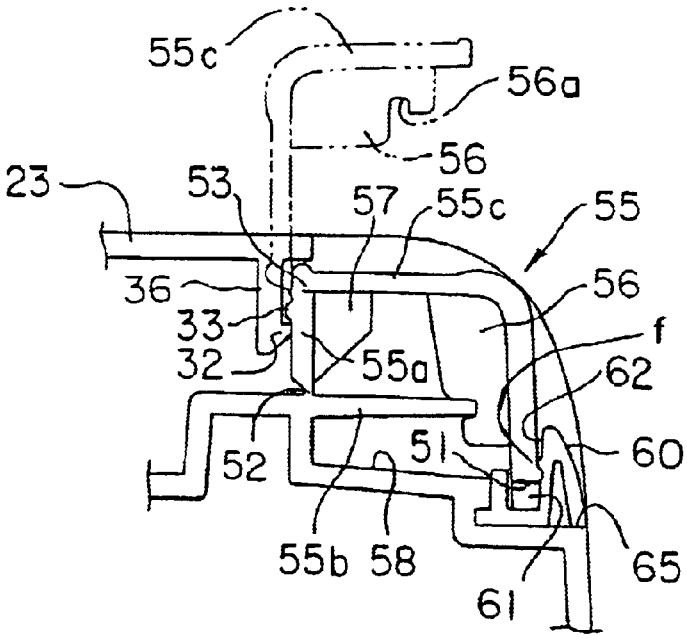
FIG. 3 is an enlarged sectional view showing a lid and an operating member on a container body.
Figure 4:
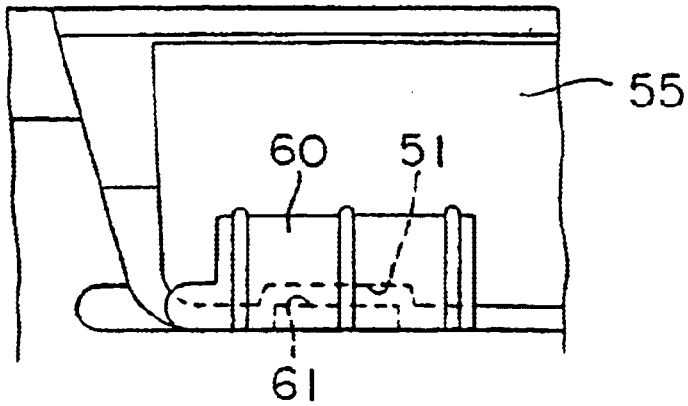
FIG. 4 is an enlarged view showing a movable member.

As shown in FIG. 3, the slider 60 has a groove 62 capable of receiving a lower end part f the cover plate 55*c*. The slider 60 slides on the slide step 65 along the lower end part of the cover plate 55*c* received therein. A protrusion 61 projects upward from the bottom of the groove 62. A recess 51 is formed in the lower end of the cover plate 55*c* to receive the protrusion 61 therein.

When the slider 60 is located at a position where the protrusion 61 of the slider 60 coincides with the recess 51 of the cover plate 55*c*, the cover plate 55*c* can be depressed as far as the protrusion 61 is received deep in the recess 51.

In a state where the protrusion 61 of the slider 60 and the recess 51 of the cover plate 55*c* are dislocated from each other, the protrusion 61 of the slider 60 is in contact with a flat part of the lower end of the cover plate 55*c*, so that the cover plate 55*c* is unable to move down even if a pressure is applied thereto and hence the lid 23 cannot be opened.

Thus, the slider 60 is moved on the slide step 65 so that the protrusion 61 of the slider 60 and the recess 51 of the cover plate 55*c* are dislocated from each other to prevent mischievous opening of the lid 23 by children. The slider 60 is a component of an operating member locking mechanism for locking the operating member 55.

As shown in FIG. 1, the top wall 27 of the container body 11 is provided with the vertical, annular wall 94 having an inner surface that engages the annular rib 37 of the lid 23. The upper edge of the annular wall 94 is chamfered to form a bevel surface 94*a* to enable the lid 23 to be easily opened even if a wet tissue 41 is caught between the annular rib 37 and the annular wall 94. The bevel surface 94*a* is formed in the entire upper edge of the annular wall 94 excluding a section corresponding to the rubber plate 50. The biasing force of the rubber plate 50 acting on a part of the annular rib 37 in the vicinity of the rubber plate 50 is high and hence the part of the upper edge of the annular wall 94 corresponding to the rubber plate 50 does not need to be chamfered and the annular rib 37 and the annular wall 94 are in close engagement.

A structure forming the opening 24 of the top plate 27 of the container body 11 will be described. As shown in FIG. 1, the first top part 27*a* of the top wall 27 is provided with a pair of first flaps 82 extending into the opening 24, and a pair of second flaps 83 extending into the opening 24. The pair of first flaps 82 and the pair of second flaps 83 are disposed opposite to each other.

Each of the pair of first flaps 82 and the pair of second flaps 83 has a wavy sectional shape extending from the base end toward the free end thereof. Thus, bending directions of the pair of first flaps 82 and the pair of second flaps 83 perpendicular to directions along the lengths of the flaps 82 and 83 are determined, so that the flaps 82 and 83 can be stably and surely bent.

The pair of first flaps 82 are extended away from each other to expand a space between the pair of first flaps 82 toward the extremities of the pair of first flaps 82, and the pair of second flaps 83 extend away from each other to expand a space between the pair of second flaps 83 toward the extremities of the pair of second flaps 83.

Figure 6A:
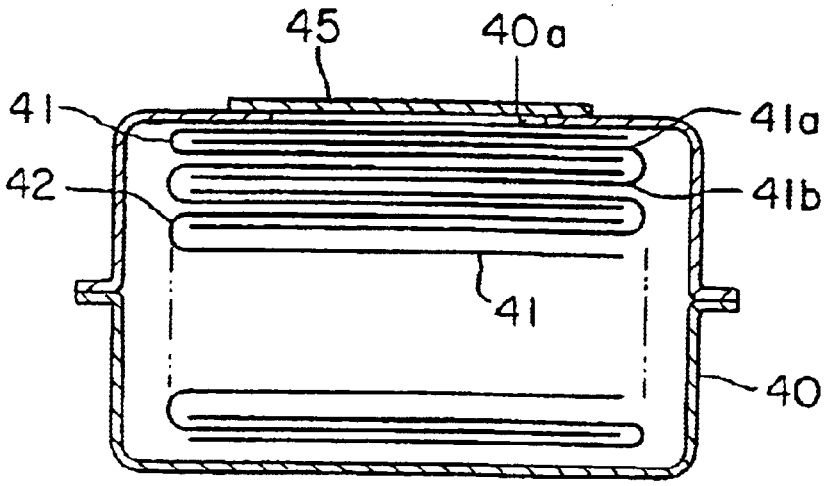
FIG. 6 is a sectional view showing a sealed pouch containing wet tissues.
Figure 6B:
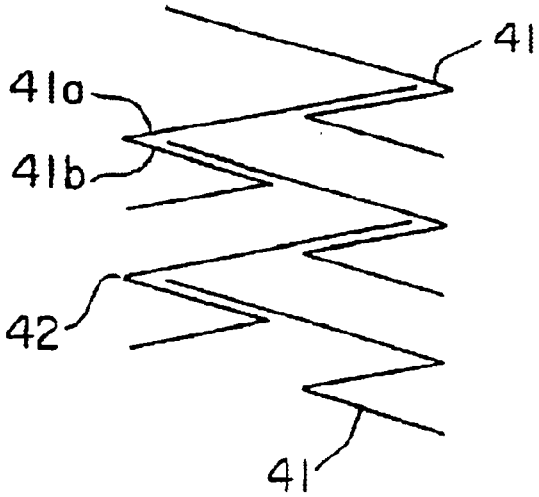

The wet tissues 41 contained in the container body 11 will be described with reference to FIG. 6. Referring to FIG. 6(*a*), the folded wet tissues 41 are piled up in a neat pile and the neat pile of the wet tissues 41 is sealed in a sealed pouch 40 formed from a soft film. Each wet tissue 41 is folded substantially in two along a fold 42. Folded wet tissues 41 respectively having folds 42 on the opposite sides are piled alternately. The lower half 41*b* of a first folded wet tissue 41 lies between the upper half 41*b* of a second folded wet tissue 41 underlying the first folded wet tissue 41 and the upper half 41*a* of a third wet tissue 41 underlying the second folded wet tissue 41. When the top wet tissue 41 is pulled out of the sealed pouch 40, the lower half 41*b* of the same wet tissue 41 pulls up the upper half 41*a* of the second top wet tissue 41. There is no particular restriction on the method of folding the wet tissues 41 and the wet tissues 41 may be folded by any folding method, provided that the wet tissues 41 can be successively taken out of the sealed pouch 40. For example, the wet tissues 41 may be folded and piled up as shown in FIG. 6(*b*). An opening 40*a* is formed in the upper wall of the sealed pouch 40 and the opening 40*a* is covered with a removable seal 45 attached to the upper wall of the sealed pouch 40.

The wet tissues 41 are formed of a water-soluble material. The wet tissues 41 may be formed of paper or may be sheets of a textile material, such as gauze or nonwoven fabric, foamed material or a paper-base soft material. A liquid with which the tissues are impregnated to provide the wet tissues 41 may be any one of wetting agents respectively containing germicides, disinfectants and detergents, and cosmetics including lotions and milky lotions.

The functions of the container with a lid in the first embodiment thus formed will be explained hereinafter.

One end of the rubber plate 50 is inserted in the slot 75 formed in the container body 11, and the other end of the rubber plate 50 is fastened to the holding part 76 formed on the lid 23 with a projection formed at a predetermined position on the lid 23 fitted in a positioning hole, not shown, formed in the other end of the rubber plate 50.

The sealed pouch 40 sealing the wet tissues 41 is put in the container body 11 through the open lower end of the container body 11.

The lid 23 is turned relative to the container body 11 in a closing direction and the stopping projection 32 of the lid 23 is engaged with the catching projection 33 of the container body 11 to close the opening 24 closely. When the lid 23 is closed, the annular rib 37 of the lid 23 is fitted closely in the annular wall 94 of the container body 11 to seal up a space surrounded by the annular rib 37.

When using the wet tissues 41, the slider 60 is moved along the slide step 65 so as to align the protrusion 61 of the slider 60 with the recess 51 formed in the cover plate 55*c*, and then the cover plate 55*c* of the operating member 55 is depressed. Consequently, the vertical wall 55*a* is bent along the thin part 52 and the horizontal wall 55*b* is bent, so that the stopping projection 32 is released from the catching projection 33. In this state, the lid 23 is turned about an axis of turning by the resilience force of the rubber plate 50 to its open position.

The top wet tissue 41 is picked up between fingers and is pulled up. Then the wet tissue 41 is pulled out of the container body 11. When the top wet tissue 41 is thus pulled out of the container body 11, the lower half 41*b* of the top wet tissue 41 pulls the upper half 41*a* of the second top wet tissue 41 into the gap between the end edges of the first flaps 82 and those of the second flaps 83. After the top wet tissue 41 has been taken out, the upper half 41*a* of the second top wet tissue 41 is held between the first flaps 82 and the second flaps 83.

Since the vertical wall 44*a* and the horizontal wall 55*b* are bent by depressing the cover plate 55*c*, the stopping projection 32 of the lid 23 and the catching projection 33 of the vertical wall 55*a* can be directly and surely disengaged. The cover plate 55*c* conceals the vertical wall 55*a* and the horizontal wall 55*b* from the outside, so that the aesthetic appearance of the container with a lid 10 is not spoiled by the vertical wall 55*a* and the horizontal wall 55*b*.

The lid 23 can be locked by dislocating the protrusion 61 of the slider 60 from the position corresponding to the recess 51 of the cover plate 55*c* to prevent the depression of the cover plate 55*c*. Thus, the mischievous opening of the lid 23 and the wasting of the wet tissues 41 by children can be prevented.

As is apparent from the foregoing description, according to the present invention, the slider is moved on the container body to align the protrusion of the slider with the recess of the cover plate. In this state, the stopping projection can be released from the catching projection simply by depressing the cover plate of the operating member to bend the vertical wall, and the lid can be opened by the resilience force of the elastic biasing member. The lid can be locked by dislocating the protrusion of the slider from the position corresponding to the recess of the cover plate to prevent the depression of the cover plate. Thus, the mischievous opening of the lid by children can be prevented.

Although a locking mechanism for locking the operating member 55 having the slider 60 has been described, the operating member 55 may be locked by a swing arm supported for turning on the lid or by a turnable stopper supported on the operating member 55 and capable engaging the container body 11.

The operating member 55 and the container body 11 may be formed separately and the operating member 55 may slide relative to the container body 11 to make the operating member 55 exercise a locking function.

Second Embodiment

A second embodiment of the present invention will be described with reference to FIGS. 7 to 11.

The second embodiment shown in FIGS. 7 to 11 has a lid fastening mechanism to fasten a lid 23 to a container body 11 instead of the operating member locking mechanism, and is substantially the same as the first embodiment shown in FIGS. 1 to 6 in other respects.

In FIGS. 7 to 11, parts of the second embodiment like or corresponding to those of the first embodiment are denoted by the same reference characters and the description thereof will be omitted.

Figure 7A:
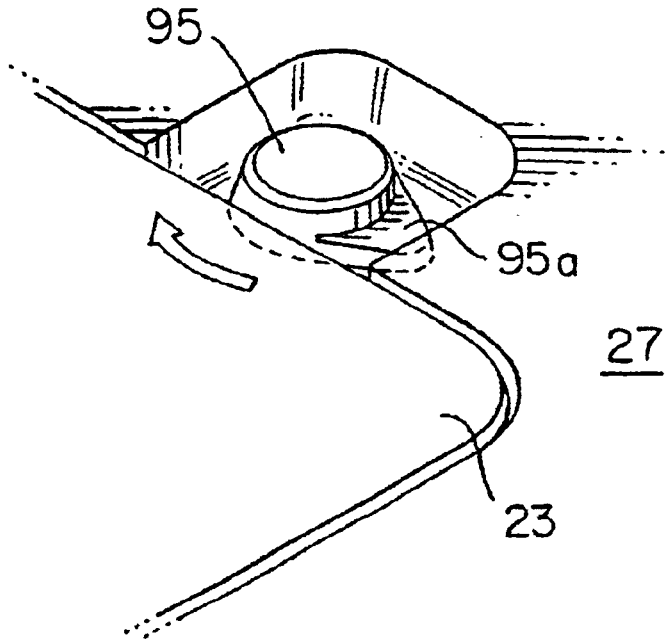
FIG. 7 is a view showing a rotary locking member provided in a container with a lid in a second embodiment according to the present invention.
Figure 7B:
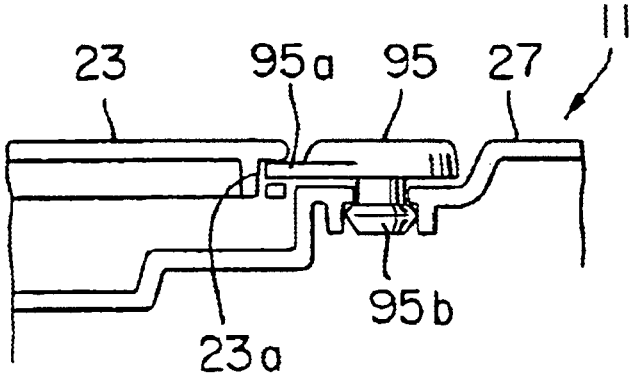

Referring to FIGS. 7(*a*) and 7(*b*), the lid fastening mechanism comprises, for example, a locking member 95 having a tongue 95*a* and a turning stem 95*b* is supported for turning on a top wall 27 of the container body 11. The locking member 95 is turned so as to insert the tongue 95*a* in a groove 23*a* formed in the lid 23 to hold the lid 23 surely on the container body 11. The locking member 95 serves as a lid locking mechanism.

Figure 8:
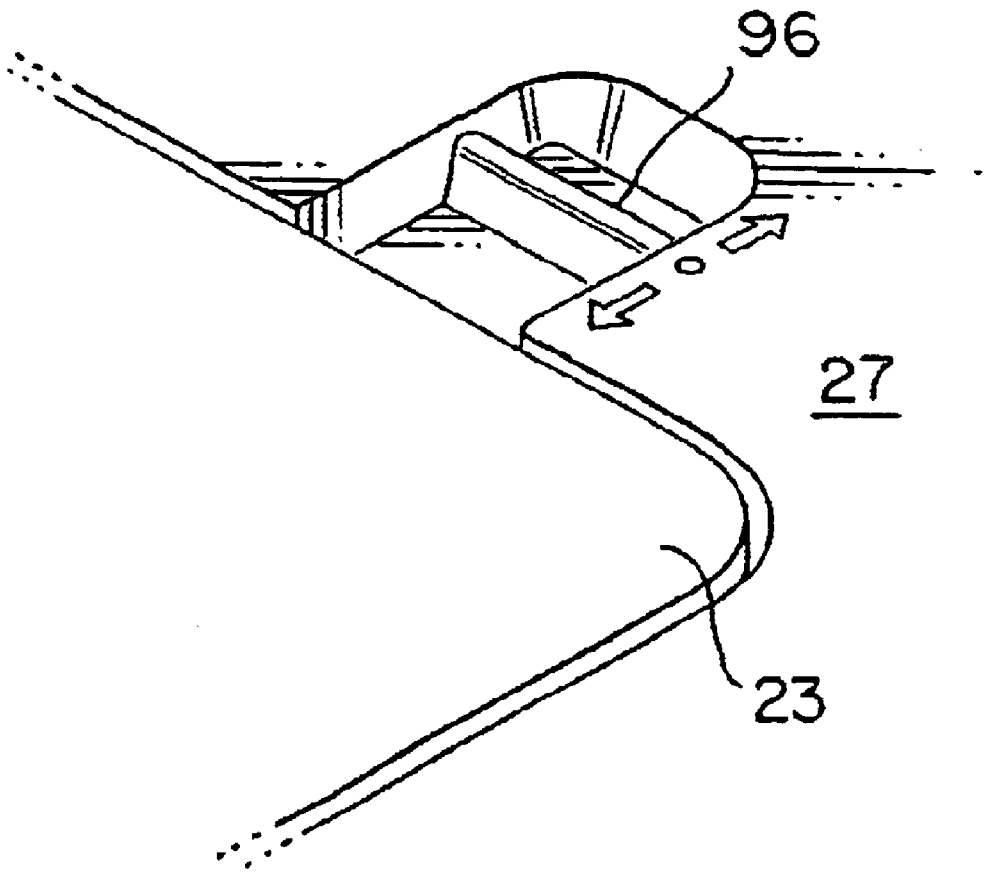
FIG. 8 is a perspective view showing a sliding locking member.

A locking member 96 shown in FIG. 8 may be employed instead of the locking member 95. The locking member 96 is supported for sliding on the top wall 27.

Figure 9A:
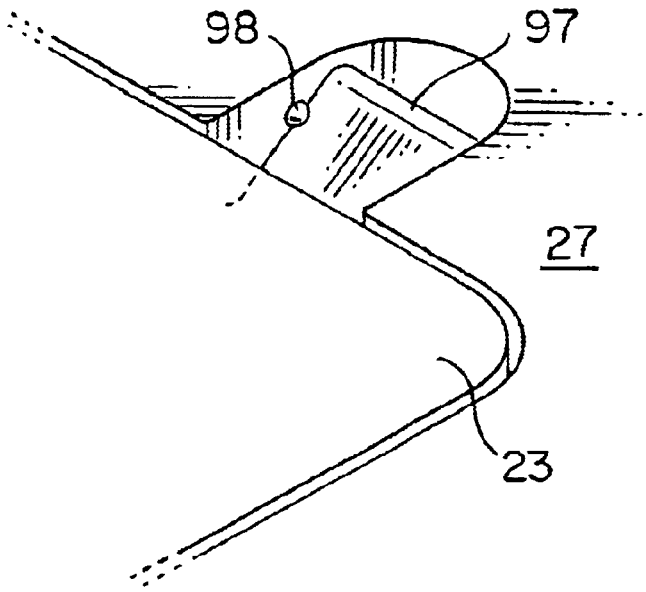
FIG. 9 is a view showing a locking tongue formed integrally with a lid.
Figure 9B:
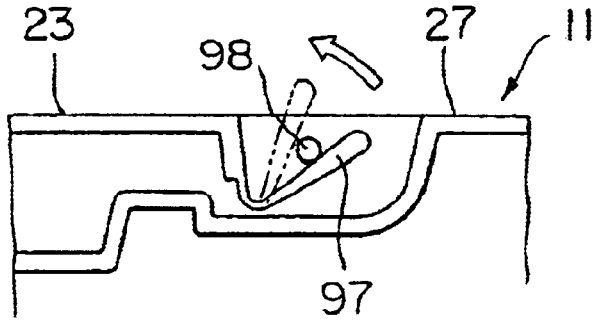

The lid 23 may be provided with a bendable locking tongue 97 as shown in FIGS. 9(*a*) and 9(*b*). The locking tongue 97 is engaged with a projection 98 formed on the container body 11 to lock the lid 23. The locking tongue 97 and the projection 98 serve as a lid locking mechanism.

Figure 10A:
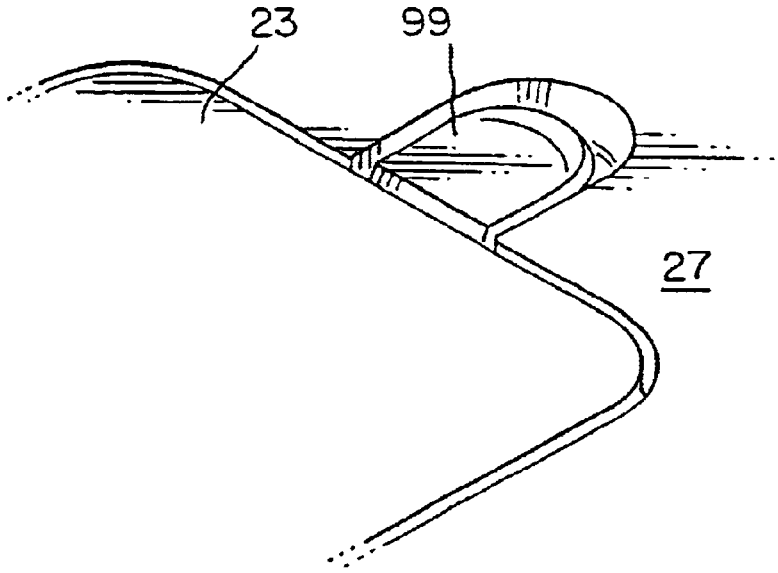
FIG. 10 is a view showing a modified locking tongue formed integrally with a lid.
Figure 10B:
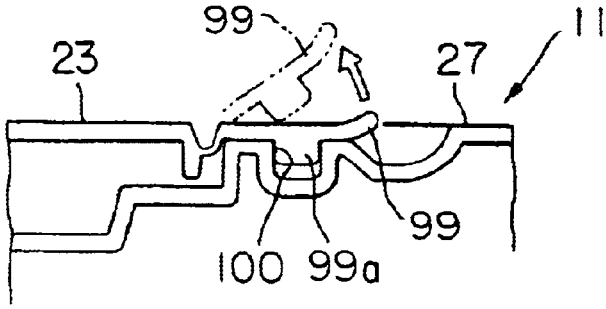

As shown in FIGS. 10(*a*) and 10(*b*), the lid 23 maybe provided with a bendable tongue 99 provided with a protrusion 99*a*. The protrusion 99*a* of the locking tongue 99 is forced into a recess 100 formed in the top wall 27 to lock the lid 23 at the closed position.

Figure 11A:
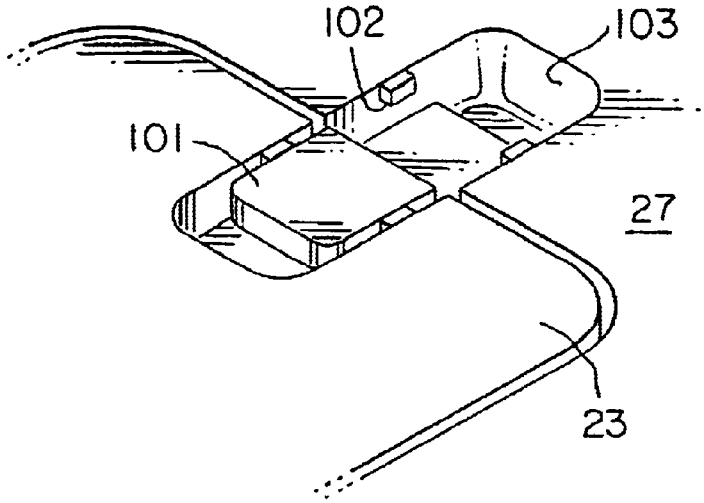
FIG. 11 is a view showing another modified a locking member formed integrally with a lid.
Figure 11B:
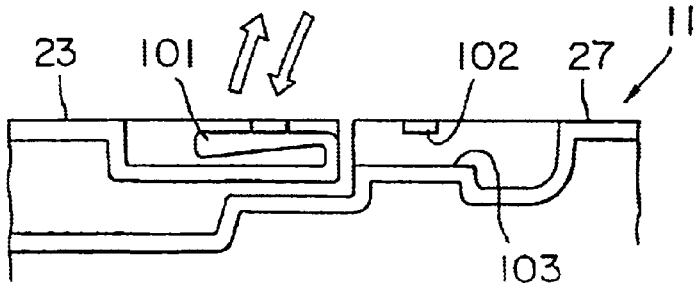

As shown in FIGS. 11(*a*) and 11(*b*), a locking member 101 may be pivotably supported on the lid 23 and the locking member 101 may be moved into a groove 103 formed in the container body 11 so as to engage projections 102 formed on side walls of the groove 10.

The operating member locking mechanism included in the first embodiment or the lid locking mechanism included in the second embodiment may be applied to a container with a lid, not shown, including a container body for containing wet tissues, having an open upper end and a top wall covering the open upper end of the container body. In this container with a lid, the top wall is provided with an opening through which the wet tissues are taken out, a turnable lid closes the opening, and an elastic biasing means in an opening direction.

As is apparent from the foregoing description, according to the present invention, the operating member can be locked by the operating member locking mechanism and the lid can be locked on the container body by the lid locking mechanism. Accordingly, the mischievous operation of the operating member by children can be prevented, and the lid cannot be accidentally opened and the useless takeout of the wet tissues can be prevented.

What is claimed is:

1. A container with a lid comprising:

a container body comprising an opening and an operating member having a catching part, the operating member being bendable by an external pressure;

a lid having a free end and a hinged end, the lid supported for rotation on the container body and for hermetically closing the opening;

an elastic biasing member located between the container body and the lid to bias the lid in an opening direction; and an operating member locking mechanism for locking the operating member, wherein the free end of the lid comprises a stopping part and the catching part catches the stopping part, the operating member locking mechanism comprises a moving member located for movement at a lower end of the operating member, a protrusion is located at one of the lower end of the operating member and the moving member, and a recess is located at the other of the lower end of the operating member and the moving member.

2. The container with a lid according to claim 1, wherein the operating member comprises a vertical wall for holding the catching part, and a cover plate connected to the vertical wall for covering the vertical wall and for bending the vertical wall when an external pressure is applied thereto.

3. The container with a lid according to claim 2, wherein a horizontal wall extends horizontally from the vertical wall, and the cover plate connects to the horizontal wall to cover the horizontal wall.

4. The container with a lid according to claim 3, wherein the horizontal wall has a width smaller than that of the vertical wall.

5. The container with a lid according to claim 2, wherein the vertical wall comprises a thin part along which the vertical wall can be easily bent.

6. The container with a lid according to claim 1, wherein the container body comprises a top plate comprising the opening and a side wall extending down from the top plate to define an open lower end, and the open lower end of the container body is closed hermetically by a bottom wall.

7. The container with a lid according to claim 1, wherein the operating member comprises a vertical wall holding the catching part, and a cover plate connected to the vertical wall so as to cover the vertical wall and for bending the vertical wall when an external pressure is applied thereto.

8. The container with a lid according to claim 7, wherein a horizontal wall extends horizontally from the vertical wall, and the cover plate connects to the horizontal wall to cover the horizontal wall.

9. The container with a lid according to claim 8, wherein the horizontal wall has a width smaller than that of the vertical wall.

10. The container with a lid according to claim 7, wherein the vertical wall comprises a thin part along which the vertical wall can be easily bent.

* * * * *